United States Patent [19]

Schramm et al.

[11] 4,012,666

[45] Mar. 15, 1977

[54] METHOD OF AND DEVICE FOR THE REMOVAL OF ELECTROSTATIC CHARGES

[75] Inventors: Jürgen Schramm, Norderstedt; Klaus Witter, Hamburg; Gerhard Krekow, Schenefeld, all of Germany

[73] Assignee: U.S. Philips Corporation, New York, N.Y.

[22] Filed: June 28, 1973

[21] Appl. No.: 374,660

[30] Foreign Application Priority Data

July 22, 1972 Germany ..... 2236083

[52] U.S. Cl. ..... 361/213; 361/214

[51] Int. Cl.[2] ..... H05F 3/06

[58] Field of Search ..... 317/2 R, 2 F, 262 A

[56] References Cited

UNITED STATES PATENTS

| | | | |
|---|---|---|---|
| 2,922,883 | 1/1960 | Giaimo | 317/262 A |
| 3,634,726 | 1/1972 | Jay | 317/2 R |
| 3,729,649 | 4/1973 | La Chappelle et al. | 317/262 A |

OTHER PUBLICATIONS

Cobine, *Gaseous Conductors*, "Theory and Engineering Applications" 1958, pp. 143–144, 205–207, 212–216, 252–253, and 264.

"Modern Dictionary of Electronics" –Graf– Howard W. Sams & Co. Inc. 1970.

*Primary Examiner*—Harry Moose

*Attorney, Agent, or Firm*—Frank R. Trifari; Bernard Franzblau

[57] ABSTRACT

A method of and apparatus for removing electrostatic charges from an insulating foil by moving the foil between first and second gas plasma generators including a novel arrangement of electrodes that produce uniform glow discharges in air adjacent the electrodes and the foil.

2 Claims, 1 Drawing Figure

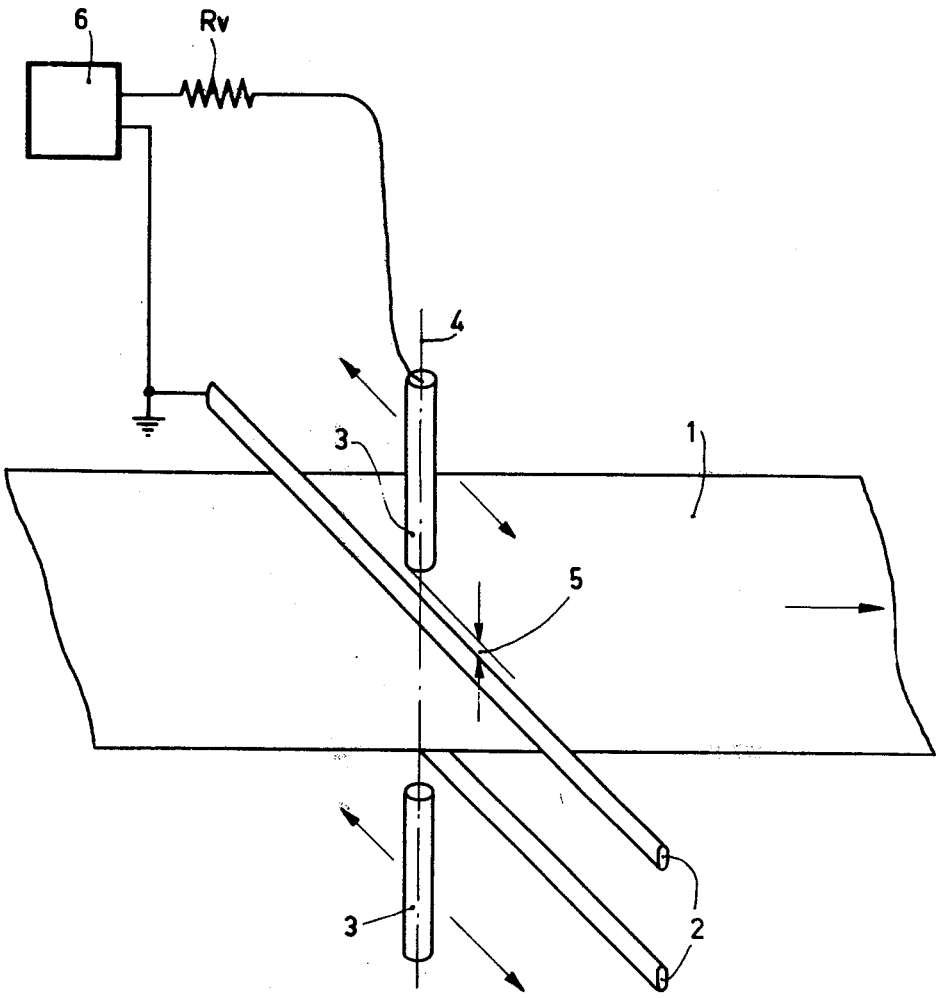
6
Rv
4
3
1
5
3
2

METHOD OF AND DEVICE FOR THE REMOVAL OF ELECTROSTATIC CHARGES

The invention relates to a method of removing electrostatic charges from an insulating foil, and to a device for performing this method.

This method is required for information recording by way of electrostatic electrography, but is also useful in other fields where insulating foils are used. Highly-insulating foils are irregularly charged by parasitic triboelectric effects, and must be brought into a virgin-like condition prior to the recording of information. On the other hand, if insulating foils which are already provided with information in the form of latent electrostatic charge images must be prepared so as to be used again in a cyclic process, the electrostatic charges present must also be removed. If it is assumed that these foils do not concern foils having photoconductive properties, the following solutions to this problem are known:

1. The use of adequately conductive liquids by means of which the electrostatic charges can be properly removed. However, the liquid residues adhering to the insulating foils must then be evaporated. 2. The reversal of the methods used to form the latent electrostatic charge images. However, the distance between the insulating foil used and the erasing device must be of the same order as the dimensions of the latent electrostatic charge images to be erased. For example, if the diameter of the charge image points to be erased is 0.1 mm, the erasing device must be brought to within a distance of approximately 0.1 mm from the insulating foil. This requirement gives rise to problems as regards the guiding of the insulating foil, and is also liable to cause contamination of the erasing device by dust particles. 3. Direct contact with grounded metal parts or other highly-conductive materials. Even though electrostatic charges can then be removed by contacting, uncontrollable charge patterns can arise due to imperfect contacting and triboelectric effects.

The said drawbacks are avoided by the method according to the invention, which is characterized in that the insulating foil is guided between two oppositely arranged, simultaneously present neutral gas plasmas which are generated by glow discharges, burning in air. Electrostatic charges present on the surfaces of the insulating foil are thus removed in a contactless manner.

As used herein, the term "neutral gas plasma" refers to a wholly or partially ionized gas in which the positive ions and the negative electrons are roughly equal in number so as to neutralize each other's effect whereby the space charge is essentially zero. Practically speaking, there is no electric field in a neutral plasma because of the neutralization of the space charge. When the concentration of ions and electrons is high, the plasma resembles a metal in that the plasma is then a good conductor of electricity.

The operation of a device based on the method according to the invention will be described hereinafter with reference to an embodiment shown in the drawing.

For the sake of clarity, the figure shows only the upper part of the erasing device completely. An insulating foil 1 is guided through a gap between two first electrodes 2 which consist of, for example, two parallel metal wires, preferably tungsten wires, which are arranged at a distance of a few millimeters from each other. In a plane perpendicular to the insulating foil 1, two second electrodes 3 are synchronously displaceable, on one line with each other with respect to their axis 4, in the longitudinal direction of the metal wires 2. Each of the electrode pairs 2, 3 constitutes a plasma generator. The air gap 5 between the movable second electrodes 3 and the first electrodes 2 is therefore chosen such that a glow discharge can be formed in air under normal circumstances. The air gap preferably amounts to some tenths of a millimeter. The second electrodes 3 are connected to voltage sources 6 via series resistors $R_v$, whereas the first electrodes 2 are grounded (this is only shown for the upper plasma generator in the figure). In a practical embodiment of the device, typical values for the glow discharge were: Working voltage between electrodes 2 and 3, 300–400 V, and current a few tens of mA. The gas plasma is then formed about the first electrodes 2, having a diameter of preferably 0.2 mm.

The operation of the gas plasma might be explained in that the latent electrostatic charges to be removed are fed through a conductive gaseous bath, which corresponds to the erasing method by means of conductive liquids, a difference being that the plasma bath consists of ions which need not be removed at a later stage. Because no field is present in the space between the first electrodes 2, there is no risk either that new charge carriers adhere to the insulating foil. The operating range of the gas plasma is so large that the displacement of the insulating foil 1 to be erased can amount to a few millimeters for any transverse movement of the pin-like second electrodes 3. If a faster displacement is desired, more than two pin-like second electrodes 3 can be displaced in parallel.

The described device can be modified into a charging device by applying a potential difference between the first electrodes 2. As a result, an electric dipole layer is produced on the insulating foil because charges of opposite sign adhere on both sides of the foil.

What is claimed is:

1. Apparatus for removing electrostatic charges from the surfaces of an insulating foil moving along a path of travel comprising, a treatment zone adjacent the travel path of the foil comprising first and second gas plasma generators for generating first and second glow discharges in air and oppositely disposed on opposite sides of the foil travel path, each plasma generator comprising a first wire electrode parallel to the plane of the foil as it passes through the treatment zone and perpendicular to the travel path, the first wire electrodes of each plasma generator being disposed parallel to one another and spaced apart to allow the passage of the foil therebetween, each plasma generator further comprising a second wire electrode spaced apart from and perpendicular to the corresponding first electrode, said second electrodes being movable in synchronism in a direction parallel to the longitudinal axes of the first electrodes, and means for applying a voltage across the first and second electrodes of each plasma generator of a value to produce a uniform glow discharge composed of a neutral gas plasma adjacent said first electrodes and any foil passing through said treatment zone.

2. Apparatus for removing electrostatic charges from the surfaces of an insulating foil moving along a path of travel comprising, a treatment zone adjacent the travel path of the foil comprising first and second gas plasma generators for generating first and second glow discharges in air and oppositely disposed on opposite sides of the foil travel path, each plasma generator comprising a first wire electrode parallel to the plane of the foil as it passes through the treatment zone and perpendicular to the travel path, the first wire electrodes of each plasma generator being disposed parallel to one another in opposed relationship and spaced apart to allow the passage of the foil therebetween, each plasma generator further comprising a second wire electrode spaced apart from and perpendicular to the corresponding first electrode, said second electrodes being linearly disposed on opposite sides of the foil and movable in a direction parallel to the longitudinal axis of the first electrode, and means for applying a voltage across the first and second electrodes of each plasma generator of a value to produce a uniform glow discharge composed of a neutral gas plasma adjacent said first electrodes and any foil passing through said treatment zone.

* * * * *